US010723030B2

(12) United States Patent
Chiu

(10) Patent No.: US 10,723,030 B2
(45) Date of Patent: Jul. 28, 2020

(54) SCRAPING TOOL

(71) Applicant: GOODLY-CH ENTERPRISE CO., LTD., Taichung (TW)

(72) Inventor: Kun-Yi Chiu, Taichung (TW)

(73) Assignee: GOODLY-CH ENTERPRISE CO., LTD., Taichung (TW)

( * ) Notice: Subject to any disclaimer, the term of this patent is extended or adjusted under 35 U.S.C. 154(b) by 0 days.

(21) Appl. No.: 16/143,605

(22) Filed: Sep. 27, 2018

(65) Prior Publication Data

US 2019/0134831 A1 May 9, 2019

(30) Foreign Application Priority Data

Nov. 8, 2017 (TW) ..... 106138683 A

(51) Int. Cl.
*B26B 5/00* (2006.01)
*A47L 13/08* (2006.01)
*B44D 3/16* (2006.01)

(52) U.S. Cl.
CPC ..... *B26B 5/006* (2013.01); *A47L 13/08* (2013.01); *B44D 3/164* (2013.01)

(58) Field of Classification Search
CPC ..... A47L 13/02; A47L 13/022; A47L 13/08; B44D 3/162; B44D 3/164; B44D 3/105; B26B 5/005; B26B 5/006; B23D 79/08; B23D 79/10
USPC ..... 30/169, 342, 329, 136, 337, 339, 162, 30/335; 15/236.01
See application file for complete search history.

(56) References Cited

U.S. PATENT DOCUMENTS 62,064 A * 2/1867 Peters et al. ..... A47L 13/08 30/169
1,171,390 A * 2/1916 Hatfield ..... B26B 5/006 30/336
1,284,808 A * 11/1918 Steers ..... B26B 5/006 30/338
1,326,596 A * 12/1919 Hyde ..... B26B 5/006 30/336
1,339,397 A * 5/1920 Jones ..... B24D 15/105 451/371
1,453,409 A * 5/1923 Scott ..... B24D 15/105 451/371

(Continued)

*Primary Examiner* — Laura M Lee
(74) *Attorney, Agent, or Firm* — Alan D. Kamrath; Karin L. Williams; Mayer & Williams PC

(57) ABSTRACT

A scraping tool includes a first holding member having a first through-groove between a first holding portion and a first connecting portion. A second holding member includes a second through-groove between a second holding portion and a second connecting portion. The second connecting portion is connected to the first connecting portion to permit the second holding member to sway relative to the first holding member between a holding position and an extended position. A locking device includes first and second abutting portion respectively abutting against the first and second holding member and a sliding portion slideably extending through the first and second through-groove. The locking device is movable relative to the first and second holding member between a locking position in which the second holding member is in the holding position and a release position in which the second holding member is movable to the extended position.

7 Claims, 5 Drawing Sheets

(56) References Cited

U.S. PATENT DOCUMENTS

| | | | | | |
|---|---|---|---|---|---|
| 1,494,956 | A * | 5/1924 | Hauser | B26B 5/006 | 30/336 |
| 1,708,905 | A * | 4/1929 | Shinn | B44D 3/162 | 30/320 |
| 1,827,509 | A * | 10/1931 | Ericsson | B26B 5/006 | 30/329 |
| 2,241,608 | A * | 5/1941 | Lurie | B26B 5/006 | 30/333 |
| 2,304,332 | A * | 12/1942 | Bodkin | B26B 5/006 | 30/335 |
| 4,381,604 | A * | 5/1983 | Horst | B44D 3/164 | 15/236.01 |
| 4,612,707 | A * | 9/1986 | Shea | B26B 29/02 | 30/162 |
| D357,776 | S * | 4/1995 | Kenny | D32/48 | |
| 6,532,670 | B1 * | 3/2003 | Berns | B26B 5/00 | 30/2 |
| 8,356,415 | B2 | 1/2013 | Lin | | |
| 2002/0096032 | A1 * | 7/2002 | Peyrot | B26B 5/00 | 83/698.11 |
| 2010/0266359 | A1 * | 10/2010 | Wahl | B26B 3/08 | 409/293 |
| 2011/0035948 | A1 * | 2/2011 | Wang | A47L 13/08 | 30/169 |
| 2011/0138566 | A1 * | 6/2011 | Wang | A47L 13/08 | 15/236.01 |
| 2019/0134831 | A1 * | 5/2019 | Chiu | B26B 5/006 | |

* cited by examiner

SCRAPING TOOL

BACKGROUND OF THE INVENTION

The present invention relates to a scraping tool and, more particularly, to a scraping tool permitting rapid replacement of a scraper blade.

U.S. Pat. No. 8,356,415 B2 discloses a scraping tool with a blade lock assembly to permit rapid assembly and replacement of a scraper blade.

The scraping tool includes a stick for hand grasp and a scraping section assembly in the front. The scraping section assembly includes a scraping section, a jaw clamp, and a scraper blade. An arm of a suitable length extends backwards from the jaw clamp and is fixed in grooves in the back side of the scraping section by two fasteners, with the two fasteners serving as pivots to swing back and forth. A control button is disposed on a location of the scraping portion corresponding to the arm and can operate 90° laterally downward.

However, the above scraping tool has a complicated structure and a high manufacturing cost. Furthermore, the scraping tool generates a holding force to tightly hold the scraper blade by a cam-like structure of the control button, and the travel of the jaw clamp is short, such that the scraper blade can only be fixed by a frictional force through tight holding. Thus, the scraper blade could slide when subject to a larger force.

Thus, a need exists for a novel scraping tool that mitigates and/or obviates the above drawbacks.

BRIEF SUMMARY OF THE INVENTION

An objective of the present invention is to provide a scraping tool including a first holding member having a first holding portion at an end thereof. The first holding member further includes a first connecting portion and a first through-groove between the first holding portion and the first connecting portion. A second holding member includes a second holding portion at an end thereof and a second connecting portion at another end thereof. The second connecting portion is connected to the first connecting portion to permit the second holding member to sway relative to the first holding member between a holding position and an extended position. The first and second holding portions are close to each other when the second holding member is in the holding position. The first and second holding portions are spaced from each other when the second holding member is in the extended position. The second holding member further includes a second through-groove between the second holding portion and the second connecting portion. The first holding member includes a first face facing away from the second holding member. The second holding member includes a second face facing away from the first holding member. A locking device includes a first abutting portion, a second abutting portion, and a sliding portion. The first abutting portion abuts against the first face. The second abutting portion abuts against the second face. The sliding portion includes a first end connected to the first abutting portion and a second end connected to the second abutting portion. The sliding portion slideably extends through the first through-groove and the second through-groove, such that the locking device is movable relative to the first and second holding members between a locking position and a release position. The second holding member is in the holding position when the locking device is in the locking position. The second holding member is movable to the extended position when the locking device is in the release position.

In an example, the first through-groove includes a first end adjacent to the first holding portion and a second end adjacent to the first connecting portion, and wherein the second through-groove includes a first end adjacent to the second holding portion and a second end adjacent to the second connecting portion.

In an example, a first distance defined between a location of the first face adjacent to the first end of the first through-groove and a location of the second face adjacent to the first end of the second through-groove is larger than a second distance defined between another location of the first face adjacent to the second end of the first through-groove and another location of the second face adjacent to the second end of the second through-groove.

In an example, the first connecting portion includes a slot. The second connecting portion includes a swaying portion and a hook. The swaying portion extends through the slot. The hook abuts against the first face.

In an example, the locking device includes a first locking member and a second locking member. The first locking member includes a screw on an end thereof adjacent to the second locking member. The second locking member includes a sliding rod on an end thereof adjacent to the first locking member. The sliding rod includes an inner threading. The screw is in threading connection with the inner threading. The screw and the sliding rod form the sliding portion. The other end of the first locking member opposite to the second locking member forms the first abutting portion. The other end of the second locking member opposite to the first locking member forms the second abutting portion.

In an example, a first jacket is mounted on the other end of the first locking member opposite to the second locking member. A second jacket is mounted on the other end of the second locking member opposite to the first locking member. The first and second jackets are made of rubber or plastic material.

In an example, the first holding portion includes two first positioning protrusions on a side thereof adjacent to the second holding member. The scraping tool further includes a scraper blade detachably mounted between the first and second holding portions. The scraper blade includes a scraping edge at a front end thereof. The scraper blade further includes first and second lateral edges on two sides of the scraping edge. The first lateral edge includes a first positioning notch. The second lateral edge includes a second positioning notch. The two first positioning protrusions are respectively received in the first positioning notch and the second positioning notch when the second holding member is in the holding position.

In an example, the second holding member includes two second positioning protrusions on a side thereof adjacent to the first holding member. The two second positioning protrusions respectively abut against the first lateral edge and the second lateral edge when the second holding member is in the holding position.

The present invention will become clearer in light of the following detailed description of illustrative embodiments of this invention described in connection with the drawings.

DETAILED DESCRIPTION OF THE INVENTION

Figure 1:
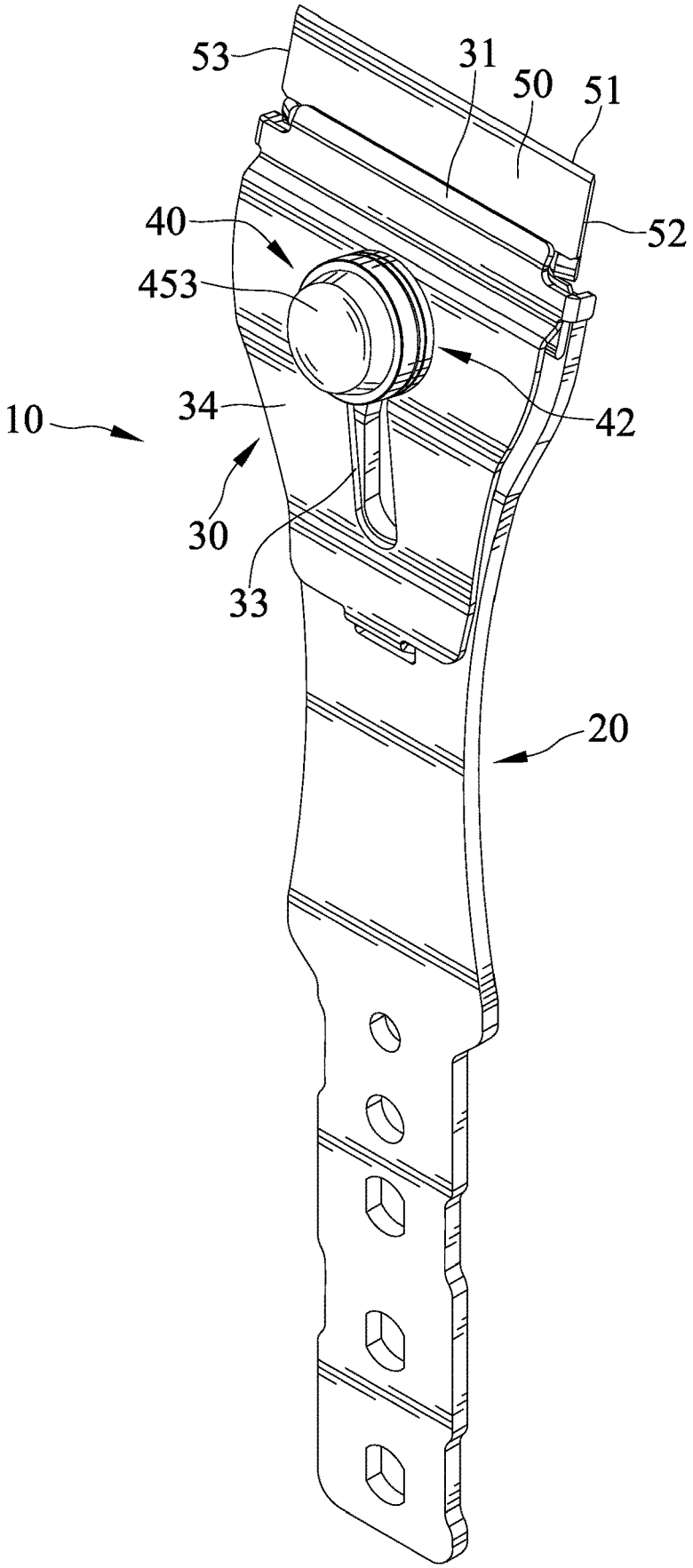
FIG. 1 is a perspective view of a scraping tool of an embodiment according to the present invention.
Figure 2:
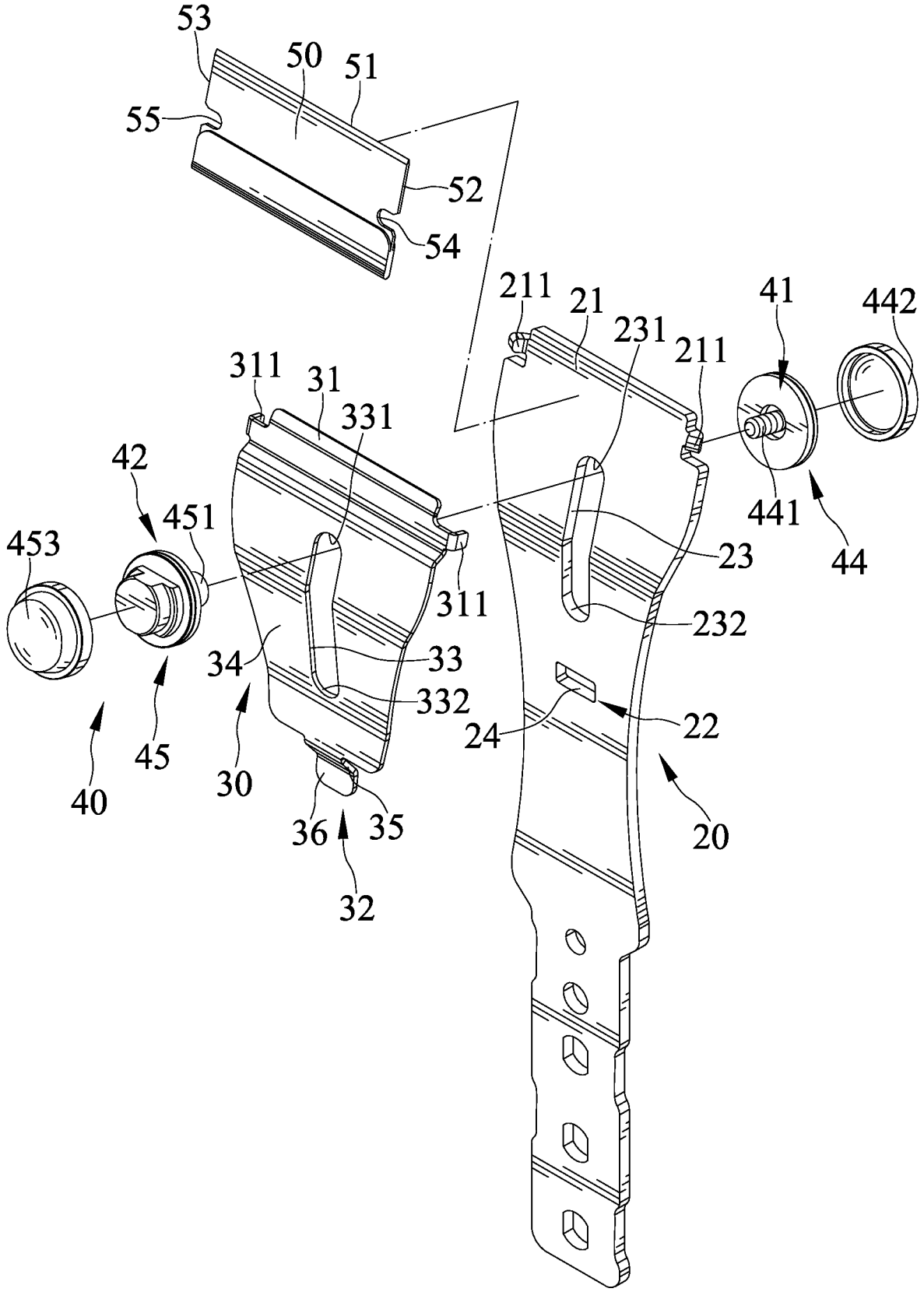
FIG. 2 is an exploded, perspective view of the scraping tool of FIG. 2.
Figure 3:
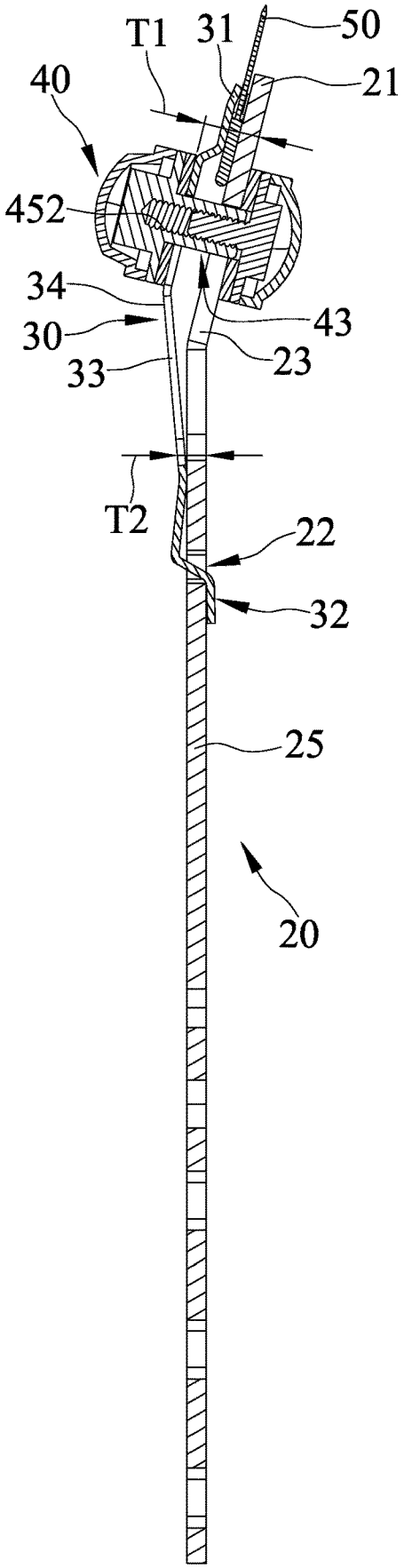
FIG. 3 is a cross sectional view of the scraping tool of FIG. 1 with a locking device in a locking position and with a second holding member in a holding position.
Figure 4:
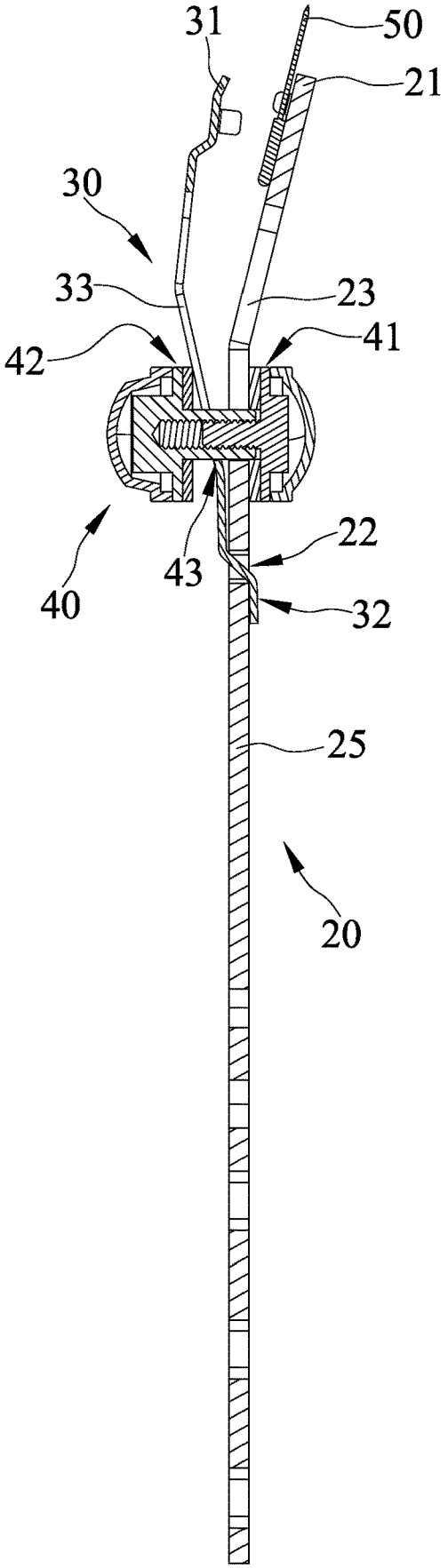
FIG. 4 is another cross sectional view of the scraping tool of FIG. 1 with the locking device in a release position and with the second holding member in an extended holding position.
Figure 5:
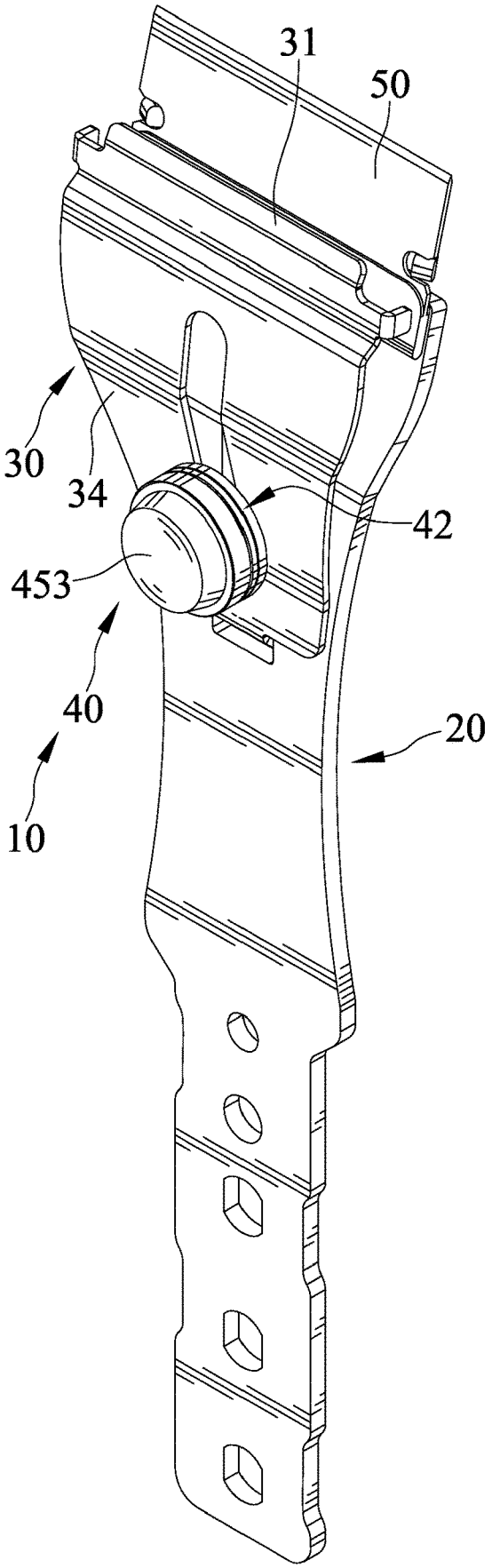
FIG. 5 is a perspective view of the scraping tool of FIG. 4.

With reference to FIGS. 1-5, a scraping tool 10 according to the present invention includes a first holding member 20, a second holding member 30, and a locking device 40.

The first holding member 20 includes a first holding portion 21 at an end thereof. The first holding member 20 further includes a first connecting portion 22 and a first through-groove 23 between the first holding portion 21 and the first connecting portion 22. The first through-groove 23 includes a first end 231 adjacent to the first holding portion 21 and a second end 232 adjacent to the first connecting portion 22. The first connecting portion 22 includes a slot 24.

The second holding member 30 includes a second holding portion 31 at an end thereof and a second connecting portion 32 at another end thereof. The second connecting portion 32 is connected to the first connecting portion 22 to permit the second holding member 30 to sway relative to the first holding member 20 between a holding position and an extended position. The first and second holding portions 21 and 31 are close to each other when the second holding member 30 is in the holding position. The first and second holding portions 21 and 31 are spaced from each other when the second holding member 30 is in the extended position.

The second holding member 30 further includes a second through-groove 33 between the second holding portion 31 and the second connecting portion 32. The second through-groove 33 includes a first end 331 adjacent to the second holding portion 31 and a second end 332 adjacent to the second connecting portion 32. The first holding member 20 includes a first face 25 facing away from the second holding member 30. The second holding member 30 includes a second face 34 facing away from the first holding member 20.

A first thickness T1 between a location of the first face 25 adjacent to the first end 231 of the first through-groove 23 and a location of the second face 34 adjacent to the first end 331 of the second through-groove 33 is larger than a second thickness T2 between another location of the first face 25 adjacent to the second end 232 of the first through-groove 23 and another location of the second face 34 adjacent to the second end 332 of the second through-groove 33. The second connecting portion 32 includes a swaying portion 35 and a hook 36. The swaying portion 35 extends through the slot 34. The hook 36 abuts against the first face 25.

The locking device 40 includes a first abutting portion 41, a second abutting portion 42, and a sliding portion 43. The first abutting portion 41 abuts against the first face 25. The second abutting portion 42 abuts against the second face 34. The sliding portion 43 includes a first end connected to the first abutting portion 41 and a second end connected to the second abutting portion 42. The sliding portion 43 slideably extends through the first through-groove 23 and the second through-groove 33, such that the locking device 40 is movable relative to the first and second holding members 20 and 30 between a locking position and a release position. The second holding member 30 is in the holding position when the locking device 40 is in the locking position. The second holding member 30 is movable to the extended position when the locking device 40 is in the release position.

The locking device 40 includes a first locking member 44 and a second locking member 45. The first locking member 44 includes a screw 441 on an end thereof adjacent to the second locking member 45. The second locking member 45 includes a sliding rod 451 on an end thereof adjacent to the first locking member 44. The sliding rod 451 includes an inner threading 452. The screw 441 is in threading connection with the inner threading 452. The screw 441 and the sliding rod 451 form the sliding portion 43. The other end of the first locking member 44 opposite to the second locking member 45 forms the first abutting portion 41. The other end of the second locking member 45 opposite to the first locking member 44 forms the second abutting portion 42.

A first jacket 442 is mounted on the other end of the first locking member 44 opposite to the second locking member 45. A second jacket 453 is mounted on the other end of the second locking member 45 opposite to the first locking member 44. The first and second jackets 442 and 453 are made of rubber or plastic material.

The first holding portion 21 includes two first positioning protrusions 211 on a side thereof adjacent to the second holding member 30. The second holding member 30 includes two second positioning protrusions 311 on a side thereof adjacent to the first holding member 20. The scraping tool 10 further includes a scraper blade 50 detachably mounted between the first and second holding portions 21 and 31. The scraper blade 50 includes a scraping edge 51 at a front end thereof. The scraper blade 50 further includes first and second lateral edges 52 and 53 on two sides of the scraping edge 51. The first lateral edge 52 includes a first positioning notch 54. The second lateral edge 53 includes a second positioning notch 55. When the second holding member 30 is in the holding position, the two first positioning protrusions 211 are respectively received in the first positioning notch 54 and the second positioning notch 55, and the two second positioning protrusions 311 respectively abut against the first lateral edge 52 and the second lateral edge 53.

In view of the foregoing, the scraper blade 50 of the scraping tool 10 according to the present invention can be detached by simply moving the locking device 40, permitting rapid replacement of the scraper blade 50. The scraping tool 10 according to the present invention has a simple structure and, thus, can be rapidly manufactured and assembled.

Although specific embodiments have been illustrated and described, numerous modifications and variations are still possible without departing from the scope of the invention. The scope of the invention is limited by the accompanying claims.

The invention claimed is:

1. A scraping tool comprising:

a first holding member including a first holding portion at an end thereof, wherein the first holding member further includes a first connecting portion and a first through-groove between the first holding portion and the first connecting portion, wherein the first connecting portion includes a slot;

a second holding member including a second holding portion at an end thereof and a second connecting portion at another end thereof, wherein the second connecting portion is connected to the first connecting portion to permit the second holding member to sway relative to the first holding member between a holding position and an extended position, wherein the first and second holding portions are close to each other when the second holding member is in the holding position, wherein the first and second holding portions are spaced from each other when the second holding member is in the extended position, wherein the second holding member further includes a second through-groove between the second holding portion and the second connecting portion, wherein the first holding member includes a first face facing away from the second holding member, wherein the second holding member includes a second face facing away from the first holding member, wherein the second connecting portion includes a swaying portion and a hook, wherein the swaying portion extends through the slot, and wherein the hook abuts against the first face, wherein the second holding member is provided with at least two turning portions, wherein one of the at least two turning portions is spaced from the first holding member, and wherein the other one of the at least two turning portions is arranged adjacent to the swaying portion and abuts against the first holding member;

a locking device including a first abutting portion, a second abutting portion, and a sliding portion, wherein the first abutting portion abuts against the first face, wherein the second abutting portion abuts against the second face, wherein the sliding portion includes a first end connected to the first abutting portion and a second end connected to the second abutting portion, wherein the sliding portion slideably extends through the first through-groove and the second through-groove, such that the locking device is movable relative to the first and second holding member between a locking position and a release position, wherein the second holding member is in the holding position when the locking device is in the locking position, and wherein the second holding member is movable to the extended position when the locking device is in the release position.

2. The scraping tool as claimed in claim 1, wherein the first through-groove includes a first end adjacent to the first holding portion and a second end adjacent to the first connecting portion, and wherein the second through-groove includes a first end adjacent to the second holding portion and a second end adjacent to the second connecting portion.

3. The scraping tool as claimed in claim 2, wherein a first distance defined between a location of the first face adjacent to the first end of the first through-groove and a location of the second face adjacent to the first end of the second through-groove is larger than a second distance defined between another location of the first face adjacent to the second end of the first through-groove and another location of the second face adjacent to the second end of the second through-groove.

4. The scraping tool as claimed in claim 1, wherein the locking device includes a first locking member and a second locking member, wherein the first locking member includes a screw on an end thereof adjacent to the second locking member, wherein the second locking member includes a sliding rod on an end thereof adjacent to the first locking member, wherein the sliding rod includes an inner threading, wherein the screw is in threading connection with the inner threading, wherein the screw and the sliding rod form the sliding portion, wherein another end of the first locking member opposite to the second locking member forms the first abutting portion, and wherein another end of the second locking member opposite to the first locking member forms the second abutting portion.

5. The scraping tool as claimed in claim 4, wherein a first jacket is mounted on the other end of the first locking member opposite to the second locking member, wherein a second jacket is mounted on the other end of the second locking member opposite to the first locking member, and wherein the first and second jacket are made of rubber or plastic material.

6. The scraping tool as claimed in claim 1, wherein the first holding portion includes two first positioning protrusions on a side thereof adjacent to the second holding member, wherein the scraping tool further includes a scraper blade detachably mounted between the first and second holding portions, wherein the scraper blade includes a scraping edge at a front end thereof, wherein the scraper blade further includes first and second lateral edges on two sides of the scraping edge, wherein the first lateral edge includes a first positioning notch, wherein the second lateral edge includes a second positioning notch, and wherein the two first positioning protrusions are respectively received in the first positioning notch and the second positioning notch when the second holding member is in the holding position.

7. The scraping tool as claimed in claim 6, wherein the second holding member includes two second positioning protrusions on a side thereof adjacent to the first holding member, and wherein the two second positioning protrusions respectively abut against the first lateral edge and the second lateral edge when the second holding member is in the holding position.

* * * * *